US005630302A

United States Patent [19]

Rosenband

[11] Patent Number: 5,630,302

[45] Date of Patent: May 20, 1997

[54] FITTING ROOM

[75] Inventor: Phillip Rosenband, Hammond, Ind.

[73] Assignee: Morgan Marshall Industries, Inc., Chicago Heights, Ill.

[21] Appl. No.: 594,674

[22] Filed: Feb. 2, 1996

[51] Int. Cl.[6] ..... E04H 1/12

[52] U.S. Cl. ..... 52/239; 52/79.1; 52/79.2; 52/34; 52/36.1; 52/242; 52/764; 52/489.1; 52/204.1; 52/210

[58] Field of Search ..... 52/79.1, 79.2, 52/79.12, 79.13, 79.9, 239, 241, 242, 243, 764, 506.06, 34, 36.1, 489.1, 204.1, 210, 213

[56] References Cited

U.S. PATENT DOCUMENTS

| | | | |
|---|---|---|---|
| 1,637,145 | 7/1927 | Hart et al. | 52/239 |
| 1,667,534 | 4/1928 | Carpenter et al. | 52/239 X |
| 2,671,538 | 3/1954 | Horowitz et al. | 52/489.1 X |
| 3,194,362 | 7/1965 | Wargo | 52/239 X |
| 3,348,346 | 10/1967 | Heim et al. | 52/239 |
| 3,733,759 | 5/1973 | Schulte et al. | 52/239 X |
| 3,769,773 | 11/1973 | Mochizuki | 52/213 X |
| 4,281,480 | 8/1981 | Wendt | 52/213 X |
| 4,281,481 | 8/1981 | Wendt | 52/213 X |
| 4,881,353 | 11/1989 | Braendel et al. | 52/239 |
| 5,036,638 | 8/1991 | Kurtz, Jr. | 52/79.1 X |
| 5,056,577 | 10/1991 | De Long et al. | 52/239 X |
| 5,067,294 | 11/1991 | McGowan | 52/239 X |

*Primary Examiner*—Wynn E. Wood
*Assistant Examiner*—W. Glenn Edwards
*Attorney, Agent, or Firm*—Laff, Whitesel, Conte & Saret, Ltd.

[57] ABSTRACT

A modular fitting room for retail store use. The fitting room provides side and front panels to define an interior space. A door panel is provided with laterally extending formations which cooperates with studs to prevent viewing of the interior space from outside of that space. Studs for mounting the door panel and for facilitating the assembly of the fitting room are also described.

5 Claims, 5 Drawing Sheets

FITTING ROOM

BACKGROUND OF THE INVENTION

A wide variety of fitting rooms are used in retail clothing stores. Typically these are fabricated on site at labor rates which are very expensive. Efforts have been made to develop prefabricated modular fitting rooms, but these tend to be expensive and complex. Additionally, fitting rooms, including modular and prefabricated fitting rooms, lack a desired degree of privacy, in part because the gaps between studs and the associated doors for the fitting rooms permit viewing of the interiors of the fitting rooms.

It would be of advantage to provide prefabricated modular fitting rooms which have enhanced security against viewing of the interior when the doors are enclosed, and which are easily fabricated for subsequent easy and inexpensive assembly at the site at which they are to be used.

SUMMARY OF THE INVENTION

In accordance with the present invention, an improved modular fitting room which is easily assembled from a minimum number of prefabricatable components is provided. The fitting room includes specially configured stud members. In one form, a fitting room of the present invention comprises a first side panel defining a first side, a second side panel defining a second side, and a front panel, the first and second side panels and the front panel defining an interior space, the front panel including a pair of spaced vertical studs and a door hinged at one side to a first of the studs for swinging movement on a vertical hinge axis between a closed position and open positions, the door including a first vertically extending lateral extension at one vertical side edge and overlapping a portion of the first stud when the door is in a closed position to prevent viewing of the interior space of the fitting room, the door including a second vertically extending lateral extension at the other vertical side edge and overlapping the second stud when the door is in a closed position to prevent viewing of the interior space of the fitting room, each of the extensions comprising metallic frame members mounted on respective vertical side edges of the door for overlapping the studs.

In a preferred form the lateral extensions are formed sheet metal members including folded returns defining the lateral extensions and U-shaped trim members embracing the door at its vertical side edges and the lateral extension at the door edge opposite the hinge axis is positioned to engage the first stud when the door is swung to a closed position and to facilitate latching the door in a closed position. Desirably the front panel further includes a header and downwardly projecting framing pin, and the second stud receives the framing pin for precisely positioning the second stud relative to the door, and the framing pin is angled in front elevation to facilitate movement of the second stud into its precise position relative to the door.

The invention also contemplates a stud for mounting a door in a prefabricated fitting room assembly, the stud comprising a metal channel defining a pair of vertically spaced cut-outs for mounting hinges for the door, metal mounting plates secured internally of the channel and enclosing each of the spaced cut-outs and defining means for mounting hinges to the mounting plates. Preferably the mounting plates define threaded holes for mounting hinge plates thereto, and the mounting plates are routed to recess hinge plates mounted thereto.

The invention also provides a stud for mounting a panel in a prefabricated fitting room assembly, the stud comprising a formed metal channel having a generally rectangular cross-section and comprising a generally U-shaped main body with angled return flanges at a back side thereof, a plurality of vertically spaced clips extending rearwardly of the back side, the clips being positioned to receive and retain the vertical edge of a panel internally of the generally U-shaped main body of the stud, and wherein the clips define formations for securing the panel to the stud. Desirably the clips are generally U-shaped and provide internal stop portions for locating the vertical edge of a panel internally of the stud.

Further objects, features and advantages of the present invention will become apparent from the following description and drawings.

DETAILED DESCRIPTION OF THE INVENTION

Figure 9:
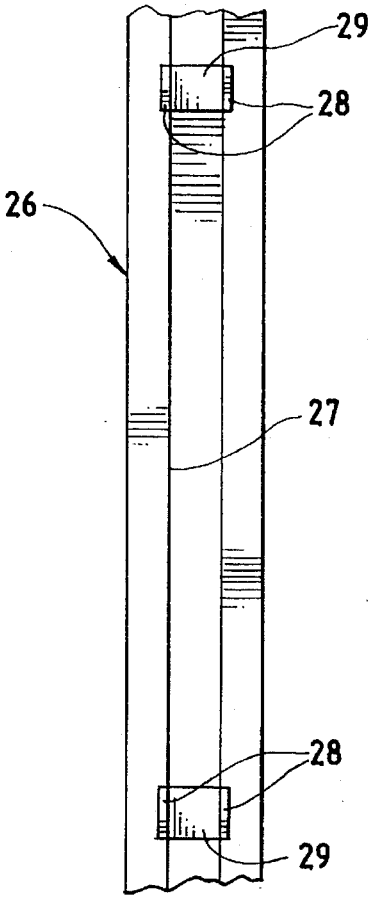
FIG. 9 is a rear elevational view of the stud of FIG. 8.
Figure 10:
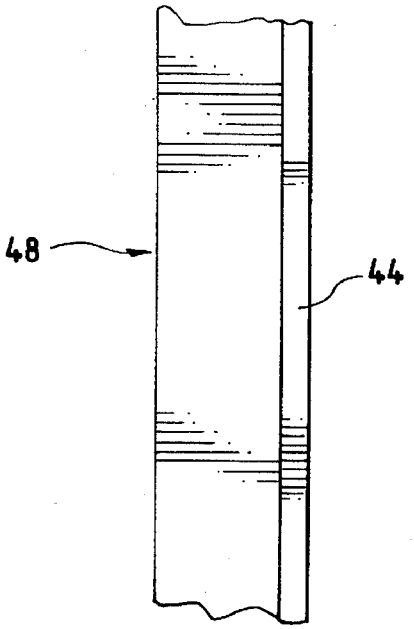
FIG. 10 is a front elevational view of a stud of FIG. 1.
Figure 11:
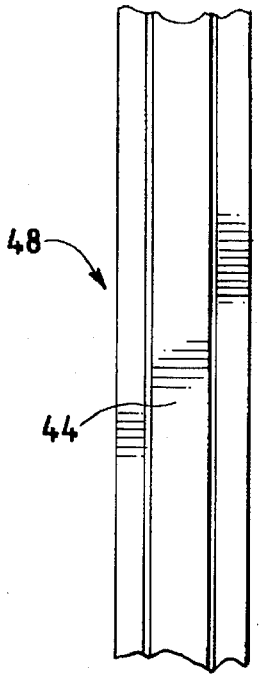
FIG. 11 is a side elevational view of the stud of FIG. 10.
Figure 12:
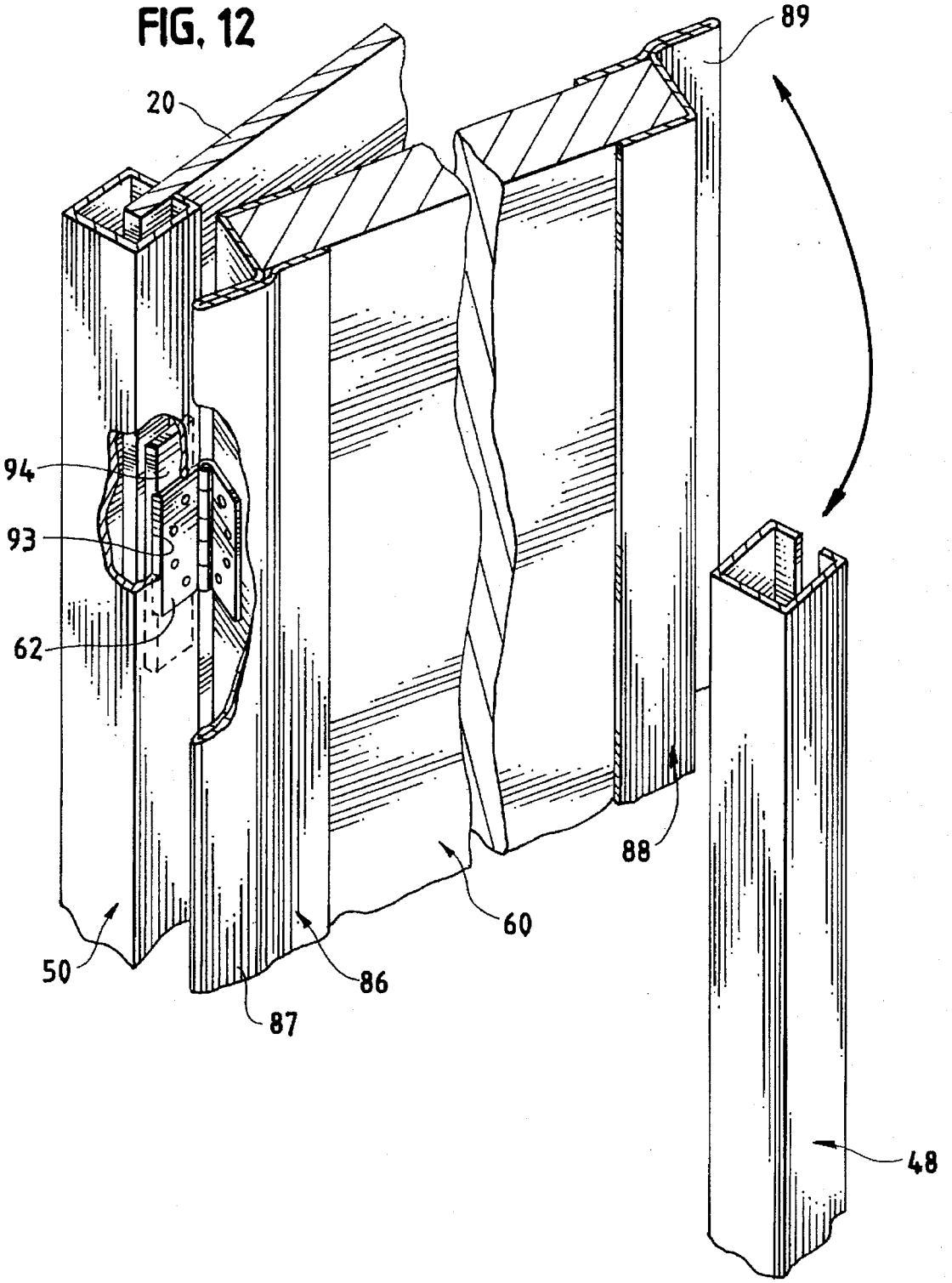
FIG. 12 is a perspective view of portions of FIGS. 1, 3 and 5–7, and showing aspects thereof.

A fitting room 1 in accordance with the present invention may comprise a substantially three-sided, open-backed assembly which is adapted to be positioned against a wall surface and which defines an interior space. Each opposite side comprises a generally rectangular side panel 20, as of particle board, which may be framed with a U-shaped trim member 22. U-shaped trim members 22 may be used at the tops and bottoms only. Each of the vertical edges of the rectangular panels 20 is secured to a vertical stud 26. Preferably the studs 26 are a formed metal channel having a rectangular cross-section and have a generally U-shaped main body with angled return flanges at the back side of the stud (See FIGS. 1 and 9). A plurality of vertically spaced clips 28 extend rearwardly of the back side. The clips 28 are positioned to receive and retain the vertical edge of a panel 20 internally of the stud and define formations for securing the panel to the stud. The clips are generally U-shaped and provide internal stop portions 29 for locating the vertical edge of a panel internally of the stud.

The rectangular side panels 20 are retained in their fixed, spaced-apart, relationship at their rear edges by a generally rectangular frame assembly 30. Frame assembly 30 is a generally rectangular array of metal channels which are secured as by welding and which serve to support a bench 33, such as a particle board panel, which may be secured thereto by suitable fasteners which extend upwardly through holes 32 in the frame assembly 30. The frame assembly 30 is mounted to the side panels 20, as by fasteners which pass through openings 34 in the frame assembly 30.

The front of the fitting room may comprise a front panel 40 which may be suitably framed at its top and bottom by U-shaped trim members 42. Panels 40 are retained within U-shaped channels 44, one of which, in the illustrated embodiment, is associated with a corner stud 46, which may be the same as stud 26, and the other of which is associated with a further stud, such as post 48.

Figure 8:
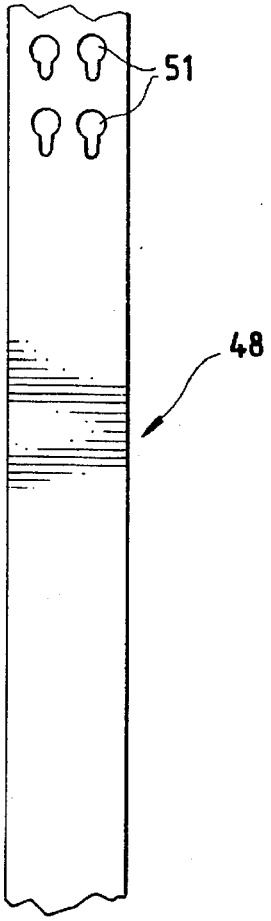
FIG. 8 is a front elevational view of a stud of FIG. 1.

To integrate the panel 40 with the stud 46 and stud 48 and to integrate the entire fitting room assembly, including stud 50, a header 52 is provided. Header 52 may be suitably secured at its opposite ends to studs 46, 50. In one form, the studs 46, 50 may be perforated as with keyhole perforations 51 (see FIG. 8) to receive and engage mounting pins projecting rearwardly from the header brackets 53 which fit into the keyhole perforations 51 for tying the studs together. A longitudinal series of fitting rooms 1 may be provided by erecting such using studs and headers to assemble and secure adjoining fitting rooms.

Figure 1:
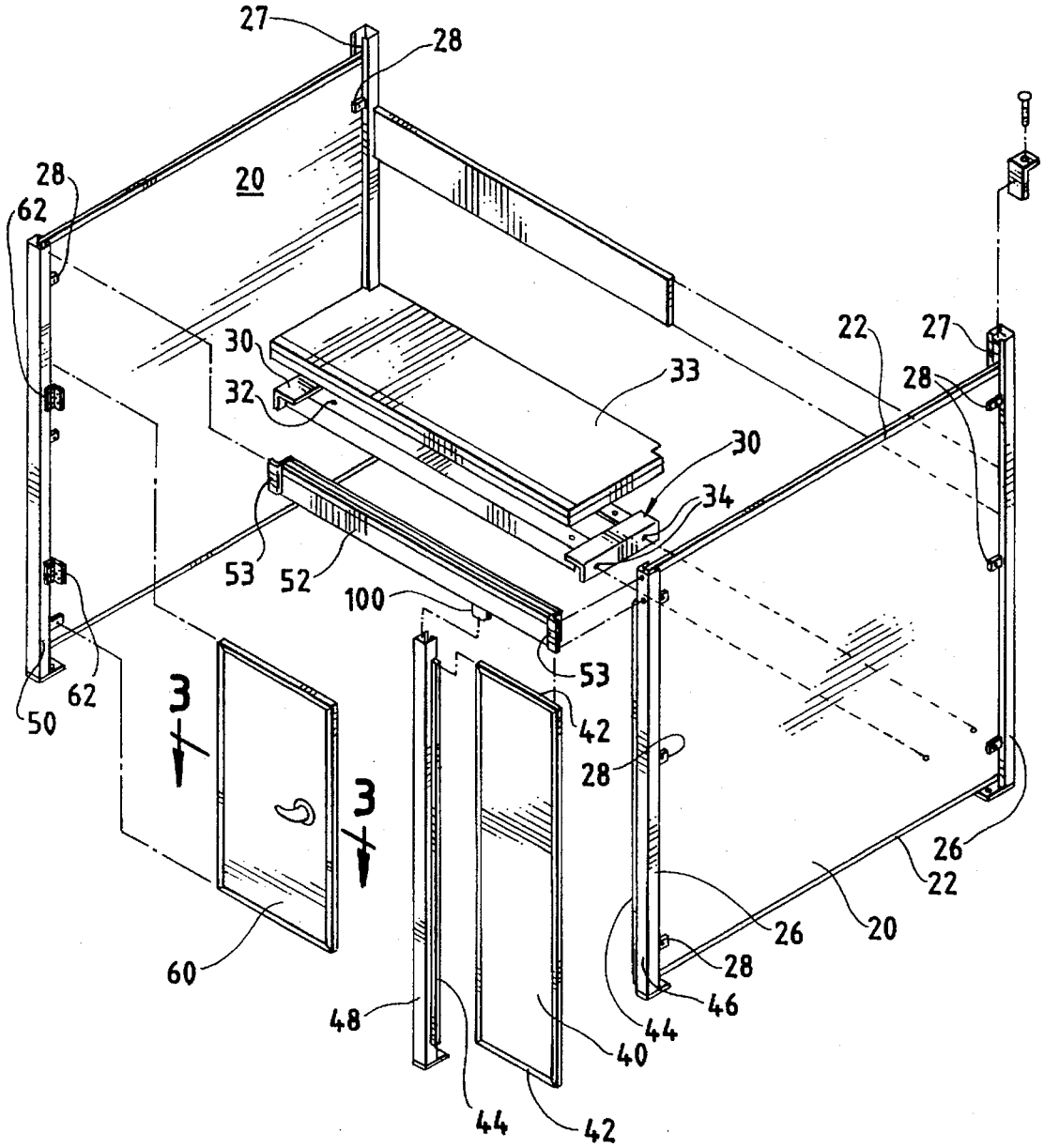
FIG. 1 is an exploded perspective view of a fitting room in accordance with the present invention.

The space between stud 48 and stud 50, as that space is defined by the header 52, is fitted with a door 60 for the fitting room. Door 60 need not be the full height of the studs 46, 50 and panel 40, but should be sufficiently high so that one may not easily see over or under the door. Door 60 is hinged at one side to the stud 50 via hinges 62 (FIG. 1). At the other side, the door 60 preferably is releasably secured to stud 48, as by a suitable conventional latch operated by a handle 64. Handle 64 cooperates with a conventional spring loaded catch which in turn latches with a strike plate provided in the confronting surface of stud 48.

Figure 2:
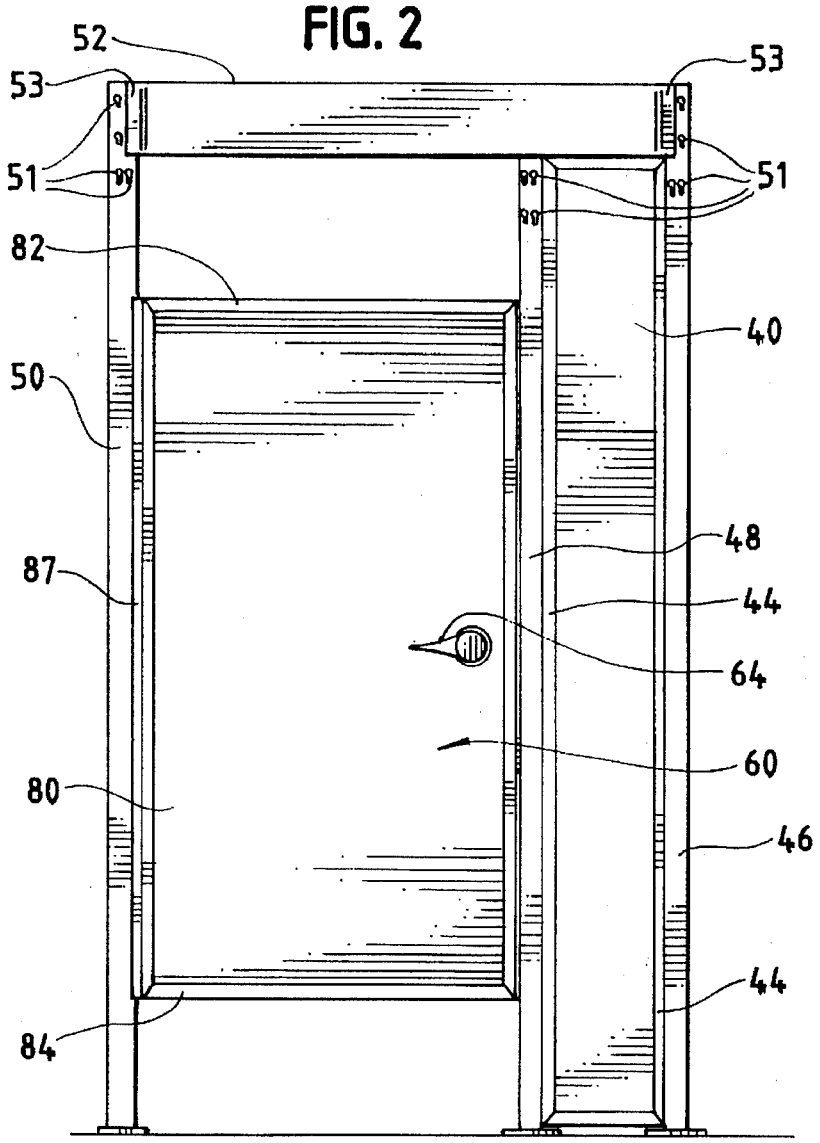
FIG. 2 is a front elevational view of the fitting room of FIG. 1.

In accordance with the present invention, the door 60 is specially constructed and configured to assure privacy. To that end, door 60 comprises a rectangular door panel 80 (FIG. 2), as of particle board, which is framed by a series of U-shaped formations which embrace the edges. These include generally U-shaped trim members 82, 84 at the top and bottom edges, and specially configured vertical metallic side edge formations 86, 88. Edge formations 86, 88 embrace opposite vertical side edges of the door panel 60, and also provide lateral extensions which mask views therepast into the fitting room.

Figure 3:
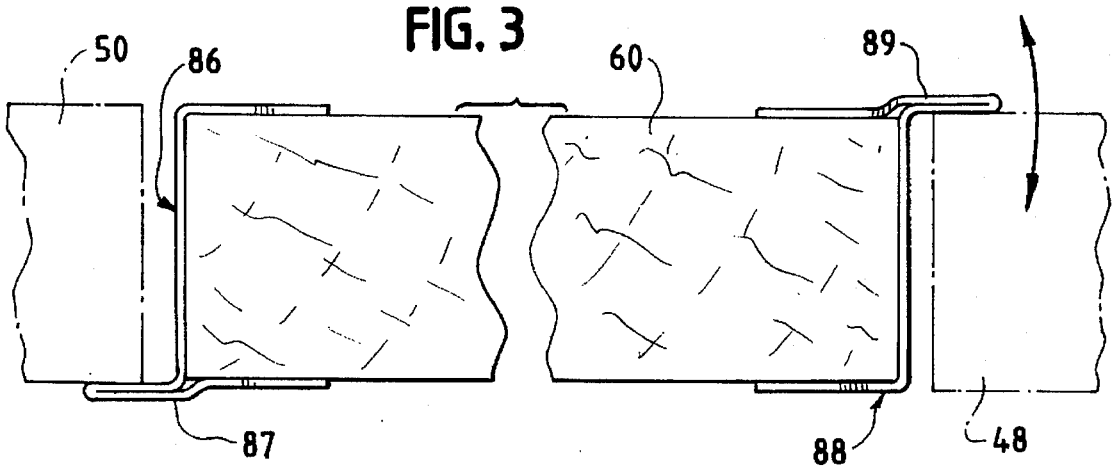
FIG. 3 is a cross-sectional view of the door of FIG. 1 taken substantially along line 3—3 of FIG. 1.
Figure 4:
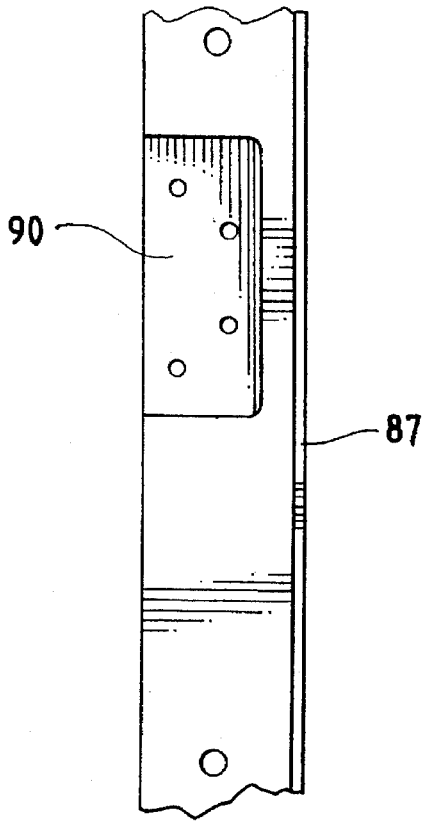
FIG. 4 is a side elevational view of the door as shown in FIG. 3.
Figure 5:
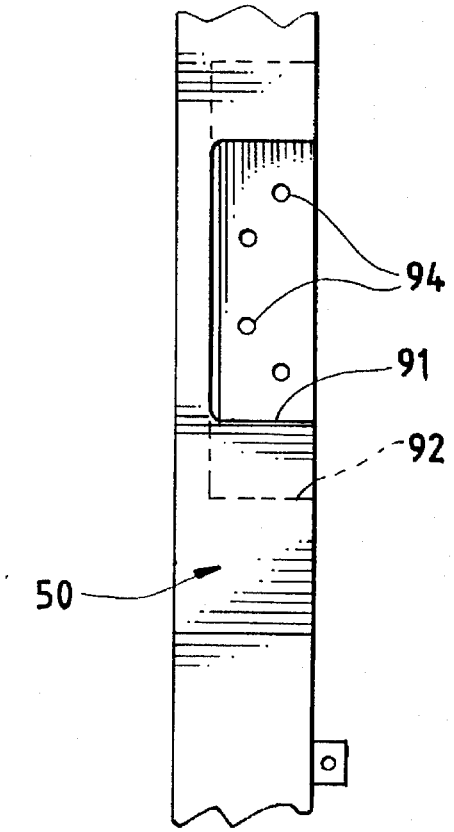
FIG. 5 is a fragmentary side elevational view of a stud of FIG. 1.
Figure 6:
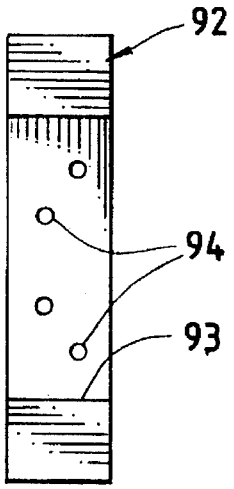
FIG. 6 is a side elevational view of a mounting plate of FIG. 5.

As best seen in FIG. 3, the vertical side edge formations 86, 88 embrace the vertical edges of the door 60. Additionally, each vertical edge formation 86, 88 also includes a lateral extension, extensions 87, 89, respectively, which serves as a modesty extension. When the door 60 is closed, extension 87 extends slightly over and overlaps the stud 50 (see FIGS. 2 and 3), thereby bridging the gap at the stud and preventing a view into the interior space of the fitting room. When the door 60 is opened inwardly via hinge 62, because the extension 87 is located laterally and forwardly, there is no interference with the opening.

When the door 60 is closed, as viewed from FIG. 3, lateral extension 89 not only prevents a view into the interior space of the fitting room 1, but also serves as a door stop which prevents swinging movement of the door beyond the position permitted by the post 48, as can be appreciated from FIG. 3. Thus, the generally parallel relationship of the members of the fitting room is maintained when the fitting room door 60 is closed.

Thus, the door stop extension 89, engages as with the stud 48, when the door is closed. The extension bridges any gap between the edge of the door as defined by the vertical edge formation 88, and the confronting edge of the stud 48, thereby to prevent any possibility of one outside of the booth being able to see into the booth between the stud 48 and the vertical edge of the door.

Likewise, one outside the booth cannot see into the booth between the stud 50 and the adjacent hinged vertical edge of the door 60. That is because the door edge is provided with extension 87 which, when the door is closed, extends laterally across the gap between the door edge and the stud 50 as explained.

Figure 7:
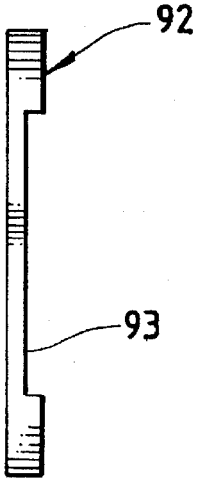
FIG. 7 is a side elevational view of the mounting plate of FIG. 6.

In accordance with the present invention, the door 60 is hingedly mounted as to a stud 50 with a minimum of parts and in a very cost efficient way. To that end, and referring to FIGS. 1 and 5–7, stud 50 is a metal channel which is notched or cut-out at two vertically spaced locations. The notches 91 cut entirely through the stud 50 and eliminate the stud material at those locations. At each of those vertically spaced locations the stud is then provided with a metal mounting plate 92. The mounting plates 92 are welded top and bottom internally of the stud 50 to firmly anchor them to the stud and to enclose each of the spaced cut-outs. The plates 92 are also routed at 93 (see FIG. 7) to provide for the proper recessing of the hinges 62 relative to stud 50 so that the hinges for the door which are secured to the mounting plates 92 are flush with the surface of the stud. The location of the mounting plates to which the hinges are threadedly secured via threaded mounting holes 94 provided therein are such that the modesty extension 87 will move, as the door 60 is closed, to a position overlapping the front edge of the stud without interference or binding.

The fitting room of FIG. 1 further includes a downwardly projecting framing pin for quickly and securely positioning a post and for anchoring it in such a way as to secure a panel 40, as between a stud 46 and a stud 48. Framing pin 100 projects vertically downwardly from the header 52. One side of pin 100 is preferably angled or cut off for ease of entry into the end of a stud 48, and so that the stud may be manipulated and moved between an outwardly contacting relationship relative to a panel 40, and a relationship in which the U-shaped formations 44 embrace the panel 40 in a rectilinear array, thereby to position the studs precisely relative to the door.

Although particular preferred embodiments of the invention have been described, it will be apparent to those skilled in the art that other modifications may be made without departing from the spirit and scope of the invention. Accordingly, the invention is to be limited only as may be made necessary by the appended claims.

What is claimed is:

1. A fitting room comprising a first side panel defining a first side, a second side panel defining a second side, and a front panel, said first and second side panels and said front panel defining an interior space, said front panel including a pair of spaced vertical studs and a door hinged at one side to one of said studs for swinging movement on a vertical hinge axis between a closed position and open positions, said door including a first vertically extending lateral extension at one vertical side edge and overlapping a front surface portion of said first stud when said door is in a closed position to prevent viewing of the interior space of said fitting room, said door including a second vertically extending lateral extension at the other vertical side edge and overlapping a rear surface portion of said second stud when said door is in a closed position to prevent viewing of the interior space of the fitting room, each of said extensions comprising metallic frame members mounted on respective vertical side edges of said door for overlapping said studs.

2. The fitting room in accordance with claim 1, and wherein said lateral extensions are formed sheet metal members including folded returns defining said lateral extensions and U-shaped trim members embracing said door at its vertical side edges.

3. The fitting room in accordance with claim 1, and wherein said lateral extension at the door edge opposite the hinge axis is positioned to engage said second stud when said door is swung to a closed position and to facilitate latching said door in a closed position.

4. A fitting room in accordance with claim 1, and wherein said front panel further includes a header having a downwardly projecting framing pin, and said second stud receives said framing pin for precisely positioning said second stud relative to said door.

5. A fitting room in accordance with claim 4 and wherein said downwardly projecting framing pin is angled to facilitate movement of said second stud into its precise position relative to said door.

* * * * *